US007568430B1

(12) United States Patent
Conley et al.

(10) Patent No.: US 7,568,430 B1
(45) Date of Patent: Aug. 4, 2009

(54) BATTLE DAMAGE ASSESSMENT SYSTEM

(75) Inventors: Kenneth A. Conley, Laplata, MD (US); Raymond M. Gamache, King George, VA (US); Jason T. Drotar, King George, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 12/287,162

(22) Filed: Oct. 1, 2008

Related U.S. Application Data

(62) Division of application No. 11/363,298, filed on Feb. 16, 2006, now Pat. No. 7,434,516.

(51) Int. Cl.
*F42B 12/22* (2006.01)
*H04B 1/034* (2006.01)

(52) U.S. Cl. ..... 102/293; 102/494; 102/509; 455/98

(58) Field of Classification Search ..... 102/206, 102/207, 209, 210, 477, 494, 506; 455/98
See application file for complete search history.

(56) References Cited

U.S. PATENT DOCUMENTS

| | | | | |
|---|---|---|---|---|
| 3,143,072 | A * | 8/1964 | Dell et al. | 102/214 |
| 3,484,627 | A | 12/1969 | Conger et al. | 310/10 |
| 3,585,419 | A | 6/1971 | Andre | 310/339 |
| 3,670,653 | A | 6/1972 | Lunt et al. | 102/210 |
| 3,922,968 | A | 12/1975 | Conger et al. | 102/70.2 |
| 3,976,898 | A | 8/1976 | Newson | 310/328 |
| 3,985,078 | A | 10/1976 | Hart et al. | 102/207 |
| 4,090,448 | A | 5/1978 | Rose et al. | 102/70.2 |
| 4,862,021 | A | 8/1989 | LaRocca | 310/10 |
| 5,014,062 | A | 5/1991 | Schriner et al. | 342/68 |
| 5,125,104 | A | 6/1992 | Ohkawa | 455/98 |
| 5,280,751 | A | 1/1994 | Muirhead et al. | 102/210 |
| 5,301,613 | A | 4/1994 | Muirhead | 102/210 |
| 6,477,932 | B2 | 11/2002 | Jung | 89/1.11 |

* cited by examiner

*Primary Examiner*—Bret Hayes
(74) *Attorney, Agent, or Firm*—Gerhard W. Thielman, Esq.

(57) ABSTRACT

A shock-triggered warhead fragment transmitter is described. The transmitter is designed to radiate a pulse upon either detonation of the warhead or impact of the fragment with the target. The pulse energy is obtained by shock de-poling of a ferroelectric material and is radiated using a dipole antenna. Detection of the radiated pulses may be used to confirm detonation of the warhead and determine the time and location of the detonation and facilitate battle damage assessment.

19 Claims, 6 Drawing Sheets

BATTLE DAMAGE ASSESSMENT SYSTEM

CROSS REFERENCE TO RELATED APPLICATION

The invention is a Division of, claims benefit of priority to and incorporates by reference in its entirety, U.S. patent application Ser. No. 11/363,298 filed Feb. 16, 2006 titled "Ferroelectric Transmitters for Warhead Design and Battle Damage Assessment" to Jason T. Drotar et al. and assigned Navy Case 96107.

STATEMENT OF GOVERNMENT INTEREST

The invention described was made in the performance of official duties by one or more employees of the Department of the Navy, and thus, the invention herein may be manufactured, used or licensed by or for the Government of the United States of America for governmental purposes without the payment of any royalties thereon or therefor.

FIELD OF THE INVENTION

This invention relates to warhead design and battle damage assessment.

BACKGROUND

Throughout history man has sought better weapons and means of conducting war. One important element contributing to successful combat and military success is battlefield intelligence. One element of battlefield intelligence is battle damage assessment (BDA), which provides information about damage inflicted on a target.

This BDA information is important for determining plans, deployment, and success of missions and/or other objectives. Such objectives may include, e.g., whether the target is destroyed, whether a weapon is effective, whether subsequent missions on the target are required, and how many. Conventional methods of BDA have relied on satellites, air reconnaissance, and field reports to determine the effectiveness of a particular weapon and/or mission. However, each of these methods has significant drawbacks.

For instance, all of these methods rely on obtaining and interpreting visual information to reach a conclusion regarding BDA; however, complete visual information often is not available for a particular target. For example, visual information may be impaired by weather, terrain, distance, the enemy, or even the target itself. Visual impairment caused by the target includes, e.g., when a warhead penetrates inside a structure. In addition, visual information requires human interpretation, which is subjective and time intensive. Furthermore, there can be significant delay between the time a target is struck and the time the visual information is obtained and interpreted.

SUMMARY

In one general aspect, a fragment transmitter includes: a ferroelectric material; and a resonant dipole transmitter in conjunction with the ferroelectric material to transmit at least one pulse upon weapon detonation. The ferroelectric material may provide a power source for the resonant dipole transmitter by de-poling when sufficiently shocked.

The ferroelectric material may be formed as a polyhedron. The resonant dipole transmitter also may include two electrodes and a spark gap formed in the ferroelectric material connected between the two electrodes by two wires.

The pulse may be transmitted at a predetermined frequency to identify the transmitter where the predetermined frequency identifies the weapon. The predetermined frequency may be determined by the curvature of the two wires. The ferroelectric material may be Lead Zirconate Titanate.

The ferroelectric material may be formed as a polyhedron have at least two opposing faces in a first and second plane and the two electrodes are formed on the two opposing faces of the polyhedron. The planes may be substantially parallel and the ferroelectric material may be polarized in a direction substantially orthogonal to the planes.

The transmitter may be shock triggered and the ferroelectric material may de-pole when the weapon is detonated and/or when the transmitter strikes a potential target.

To be detectable, the energy E of the pulse must satisfy:

$$E > \frac{4\pi k T r^2}{\lambda^2}$$

where T is the noise temperature, r is distance from the fragment transmitter to the detector, λ is the wavelength of the pulse, and k is Boltzmann's constant.

The shock and/or compression of the ferroelectric material due to detonation of the weapon causes a de-poling process that generates a surface charge upon a phase transformation of the ferroelectric material to power the dipole transmitter. The charge resulting from the de-poling is released to generate a rise in voltage between the electrodes.

The spark gap conducts when the voltage between the electrodes exceeds the breakdown voltage of the spark gap and the resulting circuit is substantially equivalent to a capacitor and inductor connected in parallel. The voltage of the circuit oscillates at a frequency determined by the capacitance of the two electrodes and the inductance of the two wires. The two wires act as a dipole antenna causing the oscillations to decay as energy is radiated away.

The shock to the ferroelectric material causes a de-poling process resulting in voltage oscillations V over time of the form $$V = V_0 e^{-\alpha t} \cos \omega t,$$

where $$\omega^2 = \frac{1}{LC} - \frac{R^2}{4L^2},$$

and $$\alpha = \frac{R}{2L},$$

where L is the inductance of the two wires, C is the capacitance of the two electrodes, and R is the sum of the effective radiation resistance of the antenna and other resistances of the circuit.

The transmitter may further include a buffer material to protect the resonant dipole transmitter upon detonation of the weapon.

In another general aspect, a battle damage assessment (BDA) system includes: a weapon including one or more fragment transmitters to radiate a pulse upon detonation of the weapon; an antenna platform to receive the pulse; and a processor to provide BDA based on the received pulse.

The BDA may include at least one of confirmation of weapon detonation, time of detonation, and location of the detonation. Other features will be apparent from the description, the drawings, and the claims.

BRIEF DESCRIPTION OF THE DRAWINGS

These and various other features and aspects of various exemplary embodiments will be readily understood with reference to the following detailed description taken in conjunction with the accompanying drawings, in which like or similar numbers are used throughout, and in which.

DETAILED DESCRIPTION

The following describes how pulse emission from ferroelectric fragments may be generated upon detonation of a warhead. The pulses may be detected by an antenna and used in battle damage assessment (BDA). Example antennas include, e.g., satellite, air, sea, or ground based antennas. Exemplary BDA includes, e.g., to confirm detonation of the warhead, time of detonation, target impact, and damage to the target. The fragment transmitters and BDA system are described in further detail below.

Figure 1:
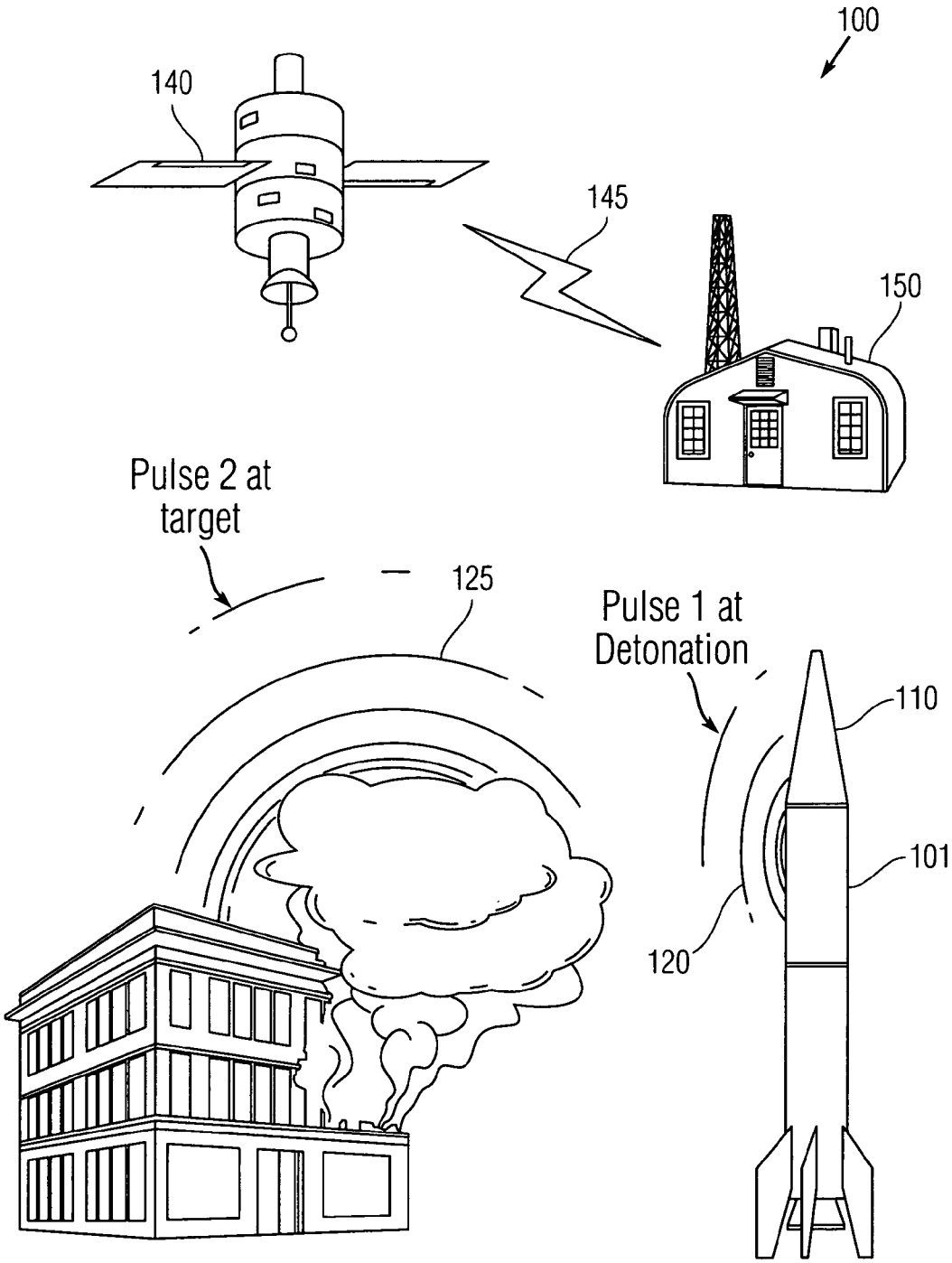
FIG. 1 shows a BDA system according to an exemplary embodiment.

As shown in FIG. 1, a BDA system 100 uses warhead fragment transmitters that are included in a warhead or other projectile weapon 110. The fragment transmitter radiates a first pulse 120 upon detonation of the warhead 110 and second pulse 125 on impact of the fragment transmitter with the target 130. The pulse energy is provided by shock de-poling of the ferroelectric material in the fragment transmitter and is radiated using a dipole antenna.

The pulses 120, 125 are received by one or more antenna platforms 140 and transmitted as pulse data via a communications link 145 to a base system 150 to be processed. The pulse data may be used to generate BDA data and reports. For example, detection of the radiated pulses can be used to confirm detonation of the warhead, determine the time and location of the detonation, and facilitate BDA of the target 130.

Figure 2:
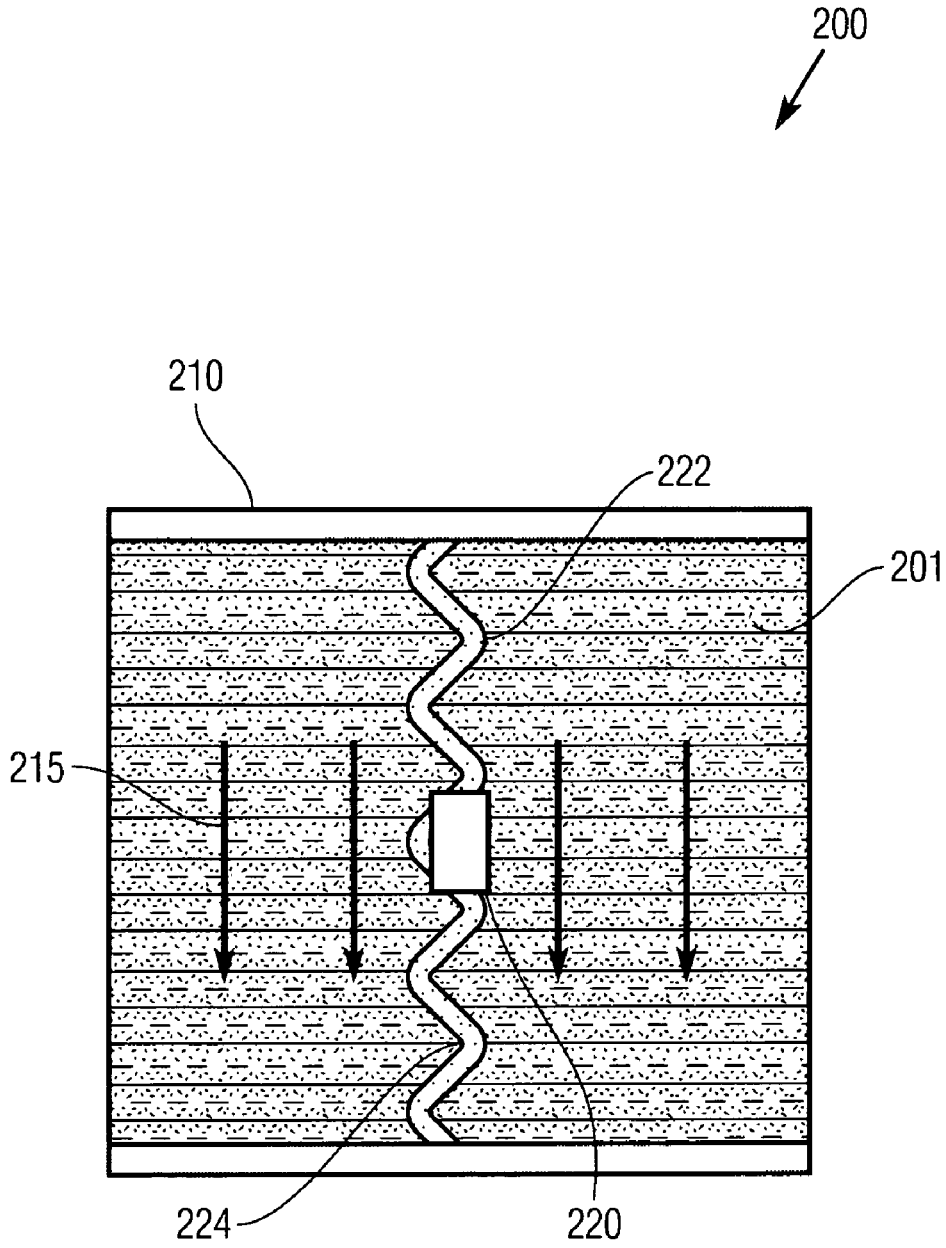
FIG. 2 shows an exemplary fragment transmitter for use in a BDA system of FIG. 1.

FIG. 2 shows an example of a fragment transmitter 200 for use in BDA. The fragment transmitter 200 may be formed of a ferroelectric material 201. In one implementation, the fragment transmitter 200 may be shaped as a polyhedron, such as, e.g., a cube. The polyhedron may be provided with at least two electrodes 210, 211 positioned on two opposing faces of the polyhedron. The ferroelectric material 201 is polarized in a direction 215 that is orthogonal to the planes of the electrodes 210, 211.

A resonant dipole transmitter may be connected between the electrodes 210, 211. The ferroelectric material 201 is de-poled when a shock wave passes through the material, for example, from detonation of the weapon. As a result of the de-poling, a charge is released to generate a rise in voltage between the electrodes 210, 211.

The resonant dipole fragment transmitter 200 includes a spark gap 220 connected between the electrodes 210, 211 by two wires 222, 224. In one implementation, the wires 222, 224 connecting the spark gap 220 to the electrodes 210, 211 may be configured in a curved path or non straight path (e.g., in either two or three dimensions) to increase their inductance.

The spark gap 220 conducts when the voltage between the electrodes 210, 211 exceeds the breakdown voltage of the spark gap 220. The resulting circuit is substantially equivalent (neglecting radiation and loss resistances) to a capacitor and inductor connected in parallel. The circuit oscillates at a frequency determined by the capacitance of the electrodes and the inductance of the wires. Furthermore, the wires 222, 224 act as a dipole antenna, causing the oscillations to decay as energy is radiated away.

The fragment transmitter 200 releases this energy when exposed to pressures high enough to de-pole the ferroelectric material 201, such as the pressures generated by warhead detonation. Detonation of the warhead de-poles the fragment transmitter 200 but does not destroy it.

The fragment transmitter 200 also sends a pulse upon impact with the target. Buffering materials, such as, for example, polymeric material may be used with the fragment transmitters 200 to reduce the level of shock experienced by the fragment transmitter 200 upon detonation of the warhead. An exemplary polymeric material would be Teflon.

Figure 3:
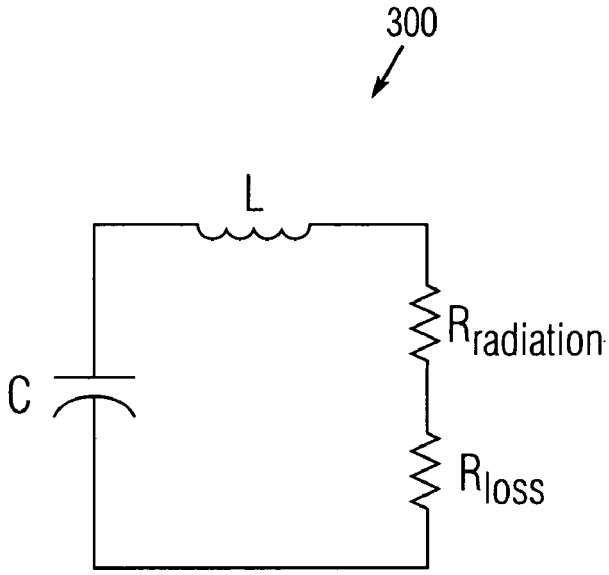
FIG. 3 is an exemplary equivalent circuit for a fragment transmitter of FIG. 2.

FIG. 3 shows an equivalent circuit 300 for the fragment transmitter 200 of FIG. 2 once the spark gap 220 conducts. As shown, the equivalent circuit 300 includes a capacitor C and inductor L connected in parallel. Those having skill in the art will recognize that such a circuit will exhibit decaying voltage oscillations over time of the form:

$$V=V_0e^{-\alpha t}\cos\omega t, \tag{1}$$

such that $$\omega^2=\frac{1}{LC}-\frac{R^2}{4L^2} \tag{2}$$

and $$\alpha=\frac{R}{2L}. \tag{3}$$

For these relations, L is the inductance of the wires, C is the capacitance of the electrodes, and R is the sum of $R_{radiation}$ and $R_{loss}$. The term $R_{radiation}$ is the effective radiation resistance of the antenna and $R_{loss}$ includes all other resistances in the circuit. The current oscillates out of phase with the voltage. Energy is transferred between the capacitance and inductance of the circuit while being dissipated by the total resistance R of the circuit. The manner in which the oscillations are initiated is described in further detail below.

The transmitting frequency of the fragment transmitter 200 may be controlled by adjusting the amount of curvature in the wires 222, 224 and thereby changing in the inductance L. In this way each warhead or a group of warheads may be given a signature frequency that may be used to identify or correlate BDA with a particular weapon.

This implementation is relatively straightforward, although there are several conditions that may effect efficient transmission of the fragment transmitter 200. For example, the resistance of the wires should be minimized. In one implementation, resistance is kept as small as possible because electrical energy dissipated in the wiring resistance is wasted. Loss resistances $R_{loss}$ should be smaller than the radiation resistance $R_{radiation}$ of the antenna. However, this configuration may limit the range of frequencies that are used. Optimal efficiency may be achieved for an antenna length that is on the order of one wavelength of the radiated pulse.

Because the fragment transmitter 200 is relatively small, this condition may be difficult to meet. Therefore, in one implementation, it is advantageous to keep the transmitting frequency as high as possible. For example, frequencies of approximately 1 GHz provide suitable efficiencies for a 1-inch (1") cube fragment. Of course other fragment sizes and frequencies are possible and may be chosen based on a specific transmitter's adaptation to a particular application.

Figure 4:
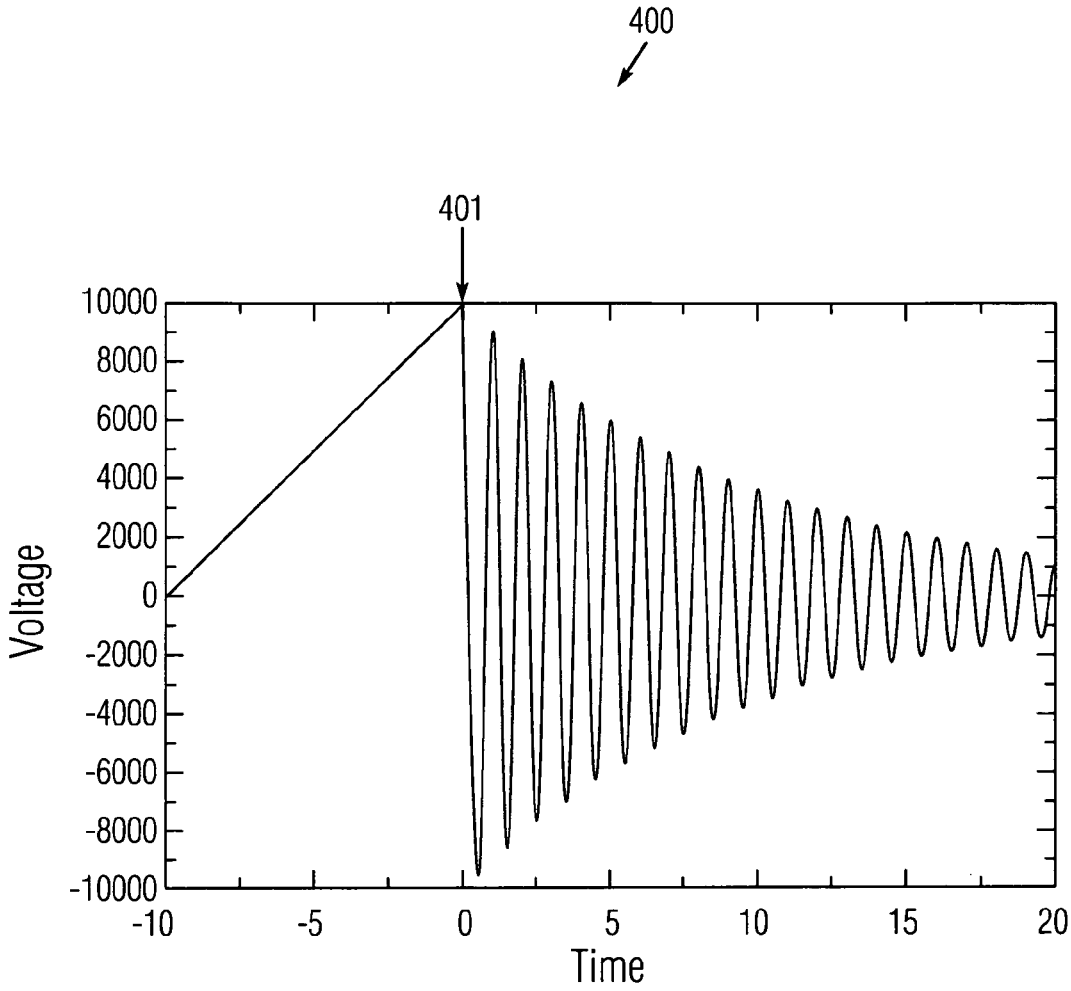
FIG. 4 is an illustration of the voltage oscillations of the fragment transmitter of FIG. 2 that has been exposed to a shock wave.

Oscillations are initiated when the fragment is exposed to a shock wave, for example, from impact or weapon detonation. FIG. 4 shows one example of oscillation as a voltage versus time curve 400. The shock wave de-poles the ferroelectric material 201 as it passes through the material and releases a charge.

The charge causes the voltage between the electrodes 210, 211 to increase in a nearly linear manner. When the voltage between the electrodes exceeds a certain value 401, the spark gap 220 conducts and the resulting equivalent circuit 300 described above occurs and the voltage oscillations commence.

Several aspects of the spark gap 220 may contribute to overall effectiveness of the fragment transmitter 200. For example, the breakdown voltage of the spark gap should be lower than the breakdown voltage of the ferroelectric material. In addition, the on-state resistance of the spark gap should be minimized.

The dynamic characteristics of the spark gap 220 also are relevant. For example, the spark gap 220 should turn on quickly enough to prevent the breakdown voltage of the ferroelectric material 201 from being exceeded and remain on until the oscillations have completed. The second condition may be easily achieved since most spark gaps have recovery times on the order of milliseconds and the pulse emission is completed within a few microseconds (because the transmitter is quickly destroyed).

There are a number of factors that influence the choice of which ferroelectric material 201 that is used in the fragment transmitter 200. For example, the available energy and the material strength of the ferroelectric material 201 are important. The material strength determines whether or not the fragment transmitter 200 survives warhead detonation. For example, a strength of greater than 0.5 kbar may be used.

The available energy limits the range of the transmitted pulse. The available energy is dependent on the maximum remnant polarization and the dielectric strength of the ferroelectric material 201. Assuming isotropic radiation, the pulse energy E must satisfy $$E > \frac{4\pi k T r^2}{\lambda^2} \tag{4}$$

to be detectable, where T is the noise temperature (i.e., a measure of the background noise level), r is distance from the fragment transmitter to the detector, $\lambda$ is the wavelength of the pulse, and k is Boltzmann's constant.

The noise temperature depends on many factors, but in many instances, it is approximately 300K. De-poling of a ferroelectric material provides about 1 J/cm$^3$, which is sufficient to produce a pulse that may be detected thousands of miles away. The primary advantage of using a ferroelectric power supply is the fact that the energy is made available very quickly (e.g., within microseconds).

In one implementation, Lead Zirconate Titanate (PZT) may be used as the ferroelectric material 201 to implement the fragment transmitter 200. PZT is a ferroelectric ceramic material that produces a large single pulse emission in a few microseconds up to a megawatt when sufficiently shocked.

The electrical response to the shock and/or compression is due to a de-poling process, which generates a surface charge upon a phase transformation of the ferroelectric material, as described above. In one example, PZT 56/44 and PZT 95/5 under shock impact, generate electrical pulses up to 1 Megawatt. Pulse durations are on the order of microseconds.

Figure 5:
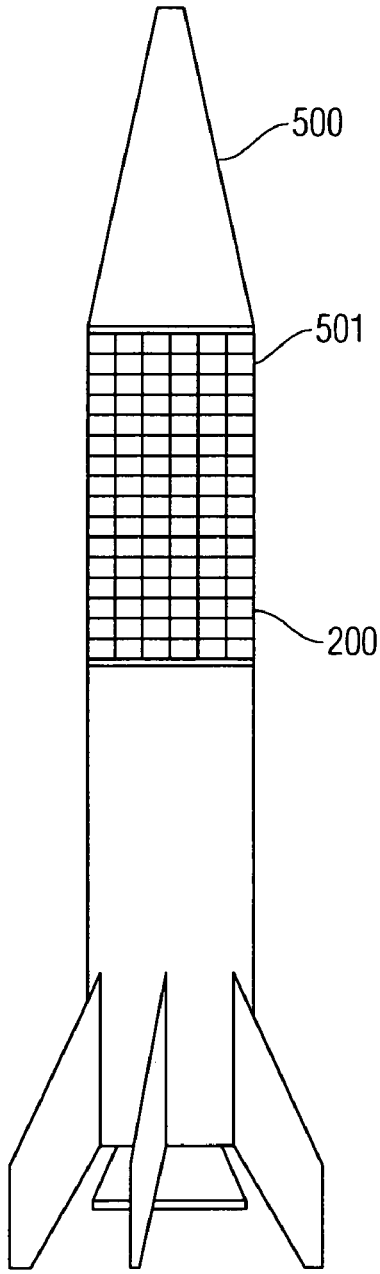
FIG. 5 is an exemplary illustration of a warhead including the fragment transmitters of FIG. 2.

FIG. 5 shows one example of the use of fragment transmitters 200 in a warhead 500. The warhead 500 may be any type of missile, bomb, or projectile. These include, e.g., including air-to-air, surface-to-air, and air-to-surface missiles, shells, artillery/motor rounds, bullets, and explosives. A percentage of the warhead fragments, casing, or other components may be replaced with the fragment transmitters 200.

The fragment transmitters 200 may be interspersed to provide even distribution, or concentrated within a desired area of the weapon. In addition, different sizes of fragment transmitters 200 may be used within the same weapon. The fragment transmitters 200 may be placed in the fuse well of the warhead 500; however, other configurations are possible. In addition, the fragment transmitters may be buffered to prevent or minimize damage during detonation. Specific frequencies may be chosen for the weapon to identify the weapon after deployment.

Figure 6:
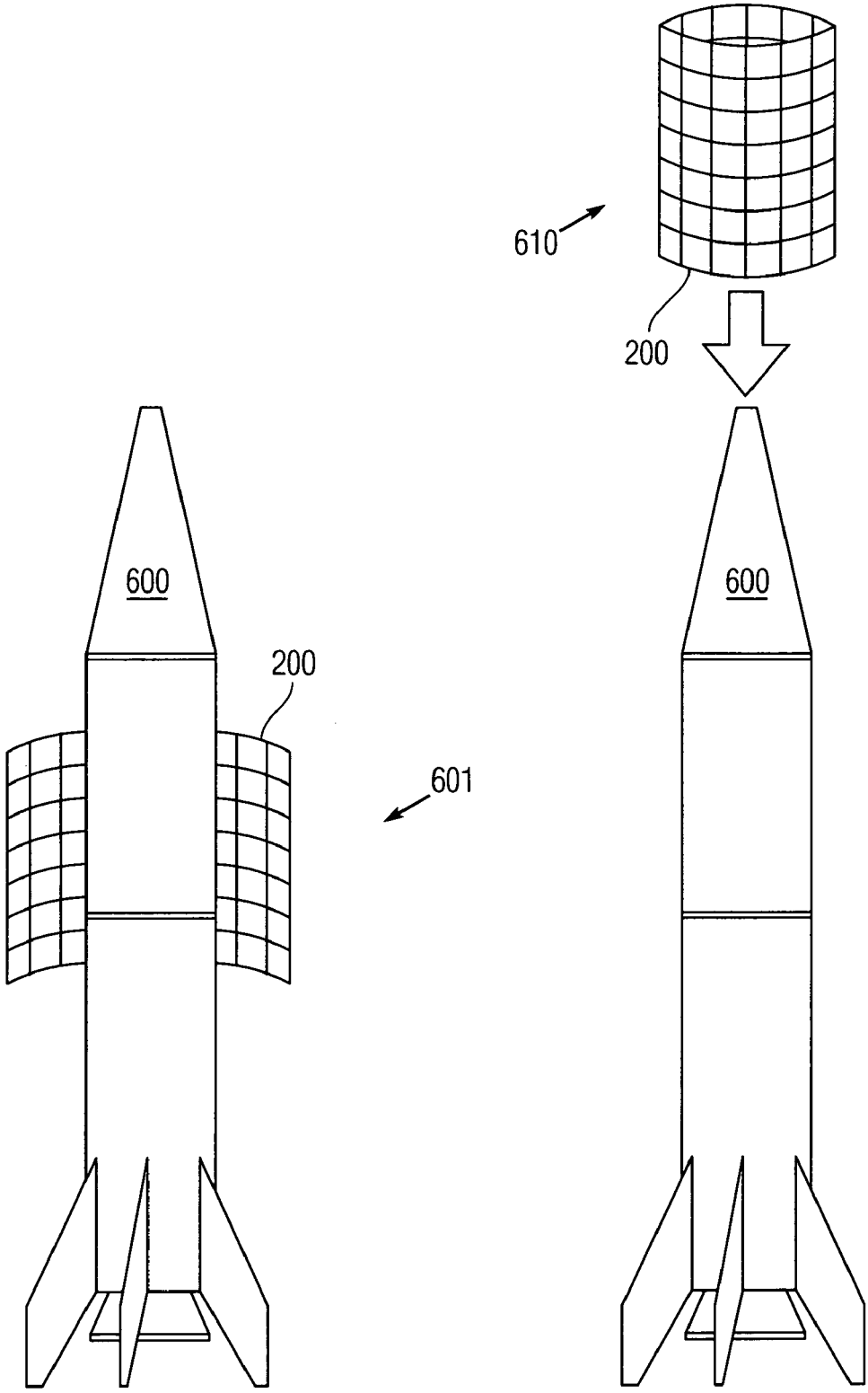
FIG. 6 is an exemplary illustration of fragment transmitters of FIG. 2 being retrofitted to an existing warhead.

In another implementation, as shown in FIG. 6, the fragment transmitters 200 may be retrofit to existing weapons 600. As shown, the fragment transmitters 200 may be retrofit using a wrap 601. The wrap 601 may be implemented using a mat that includes fragment transmitters 200 that are attached around the exterior of the warhead 600.

Similarly, a patch (not shown) also may be used. In another implementation, a sleeve 610 including fragment transmitters 200 may be retrofit over the exterior of the warhead 600. The wrap 600, patch, or sleeve 610 may be attached to the warhead 600 using an adhesive or through a mechanical fastening mechanism.

Figure 7:
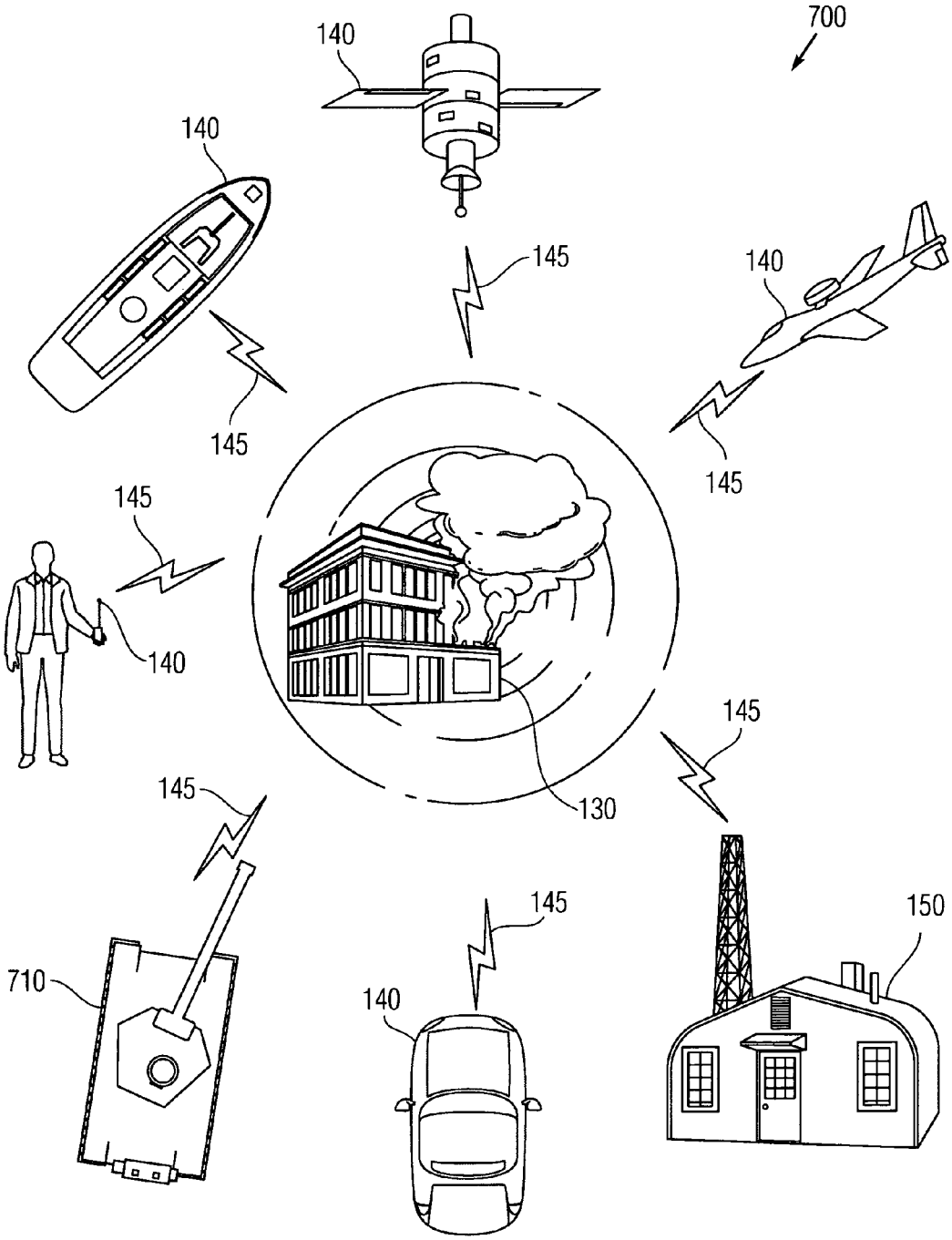
FIG. 7 is an exemplary BDA system.

FIG. 7 shows an exemplary BDA system 700. A weapon platform 701 fires a weapon/warhead equipped with the fragment transmitters 200 at a target 730. The weapon platform 701 may include, e.g., a ground vehicle, an artillery piece, a weapon launcher, a fixed and non-fixed wing aircraft, a space vehicle, and/or a naval vessel. When the weapon detonates, the fragment transmitters 200 may emit a pulse. When the fragment transmitters 200 strike the target they may emit a pulse.

Land, air, sea, and space based antenna platforms 740 receive the pulse transmissions at a predetermined frequency based on the fragment transmitters 200 and, for example, the inductance of the wires 222, 224 chosen for the dipole antennas. Such antenna platforms 740 include, e.g., a field unit, a ground vehicle, an aircraft, a naval vessel, and a space vehicle.

The pulse transmissions are received by the antenna platform 740 and may be filtered and converted to digital data. The data may be transmitted via a communications link 745 to a command center, base, or post 750. The digital data may be stored in a memory device and provided to a processing device, for example, at the base or command post 750. The processing device may be programmed to interpret the weapon data and prepare a BDA report based on the data received.

The pulse data may be processed to determine both phase 1 and phase 2 information about the weapon and the target. For example, the pulse data may be used to determine if the warhead properly detonated, the time of detonation, the coordinates or place of detonation, and damage to the target. This information may be used for many purposes, such as evaluating the efficiency of the weapon, its suitability for the target, if further missions are needed to destroy the target and how many.

In addition, the information may be used for fire support, for example, to correct and/or adjust fire missions. Because the data are precise and collected quickly and accurately, BDA quality and turnaround times may be greatly increased over conventional methods. BDA also may be provided even though there is no line of sight of visual observation of the target. Furthermore, the BDA system is not impaired by weather or other obstructions, such as, e.g., time-on-target.

A number of exemplary implementations have been described. Nevertheless, it will be understood that various modifications may be made. For example, the design of a fragment transmitter involves many tradeoffs, and any number of different designs are possible consistent with the description above. For example, suitable results may be achieved if components in a described component, system, architecture, or devices are combined in a different manner and/or replaced or supplemented by other components. Accordingly, other implementations are within the scope of the following claims.

What is claimed is:

1. A battle damage assessment (BDA) system comprising:

a weapon including at least one fragment transmitter to radiate a pulse upon detonation of the weapon; the transmitter further comprising:

two electrodes;

a ferroelectric material disposed between the two electrodes;

a spark gap formed in the ferroelectric material connected to each electrode by a wire; and a resonant dipole transmitter in conjunction with the ferroelectric material to transmit at least one pulse upon weapon detonation that compresses the ferroelectric material;

an antenna platform to receive the radiated pulse as a received pulse; and a processor to provide BDA based on the received pulse, wherein compression of the ferroelectric material causes de-poling by phase transformation to produce temporal voltage oscillations V of $$V=V_0e^{-\alpha t}\cos\omega t,$$

such that $$\omega^2=\frac{1}{LC}-\frac{R^2}{4L^2},$$

and $$\alpha=\frac{R}{2L},$$

where L is inductance of the two wires, C is capacitance of the two electrodes, and R is a sum of $R_{radiation}$ and $R_{loss}$ such that $R_{radiation}$ is effective radiation resistance of the two wires, and $R_{loss}$, includes other resistances of the transmitter.

2. The system of claim 1, wherein the ferroelectric material provides a power source for the resonant dipole transmitter by de-poling when sufficiently shocked.

3. The system of claim 1, wherein the ferroelectric material is formed as a polyhedron.

4. The system of claim 1, wherein the resonant dipole transmitter includes two electrodes and a spark gap formed in the ferroelectric material connected between the two electrodes connected by two wires.

5. The system of claim 4, wherein the pulse is transmitted at a predetermined frequency determined by curvature of the two wires.

6. The system of claim 1, wherein the pulse is transmitted at a predetermined frequency to identify the transmitter.

7. The system of claim 6, wherein the predetermined frequency is used to identify the weapon.

8. The system of claim 6, wherein the ferroelectric material is formed as a polyhedron having at least two opposing faces in a first and second plane and the two electrodes are formed on the two opposing faces of the polyhedron.

9. The system of claim 8 wherein the planes are substantially parallel and the ferroelectric material is polarized in a direction substantially orthogonal to the planes.

10. The system of claim 1, wherein the ferroelectric material is Lead Zirconate Titanate.

11. The system of claim 1, wherein the transmitter is shock triggered and the ferroelectric material de-poles in response to detonation of the weapon.

12. The transmitter of claim 11, wherein the transmitter is shock triggered and the ferroelectric material de-poles in response to the transmitter striking a potential target.

13. The system of claim 11, wherein the energy E of the pulse satisfies $$E>\frac{4\pi kTr^2}{\lambda^2}$$

where T is the noise temperature, r is distance from the transmitter to the detector, λ is pulse wavelength, and k is Boltzmann's constant.

14. The transmitter of claim 1, wherein the transmitter is shock triggered and the ferroelectric material de-poles in response to the transmitter striking a potential target.

15. The system of claim 1, wherein the spark gap conducts in response to voltage between the electrodes exceeding breakdown voltage of the spark gap and the transmitter behaves as a circuit having a capacitor and an inductor connected in parallel.

16. The system of claim 15, wherein the voltage of the circuit oscillates at a frequency determined by the capacitance of the two electrodes and the inductance of the two wires.

17. The system of claim 16, wherein the two wires act as a dipole antenna causing voltage oscillations to decay as energy radiates away.

18. The system of claim 1, wherein the transmitter further comprises a buffer material to protect the resonant dipole transmitter upon detonation of the weapon.

19. The system of claim 1, wherein the BDA includes at least one of confirmation of weapon detonation, time of detonation, and location of the detonation.

* * * * *